US009812793B2

(12) United States Patent
Bury et al.

(10) Patent No.: US 9,812,793 B2
(45) Date of Patent: Nov. 7, 2017

(54) ELECTRICAL CONNECTOR WITH A SHEATH CLAMP

(71) Applicant: Phoenix Contact GmbH Co. KG, Blomberg (DE)

(72) Inventors: Joachim Bury, Herford (DE); Thomas Salomon, Verl (DE)

(73) Assignee: Phoenix Contact GMBH & CO. KG, Blomberg (DE)

( * ) Notice: Subject to any disclaimer, the term of this patent is extended or adjusted under 35 U.S.C. 154(b) by 0 days.

(21) Appl. No.: 15/033,699

(22) PCT Filed: Nov. 3, 2014

(86) PCT No.: PCT/EP2014/073596
§ 371 (c)(1),
(2) Date: May 2, 2016

(87) PCT Pub. No.: WO2015/063305
PCT Pub. Date: May 7, 2015

(65) Prior Publication Data

US 2016/0268705 A1 Sep. 15, 2016

(30) Foreign Application Priority Data

Nov. 4, 2013 (DE) ..... 10 2013 112 083
Nov. 4, 2013 (DE) ..... 10 2013 112 084

(51) Int. Cl.
*H01R 11/03* (2006.01)
*H01R 4/32* (2006.01)
*H01R 13/04* (2006.01)

(52) U.S. Cl.
CPC ..... *H01R 4/32* (2013.01); *H01R 13/04* (2013.01)

(58) Field of Classification Search
CPC ..... H01R 4/32
(Continued)

(56) References Cited

U.S. PATENT DOCUMENTS 4,375,311 A 3/1983 Feldman
6,361,382 B1 * 3/2002 Yamada ..... H01R 4/302 439/801

(Continued)

FOREIGN PATENT DOCUMENTS

CH 364 825 A 10/1962
DE 683 862 A 10/1939

(Continued)

OTHER PUBLICATIONS

ISA/EP, International Search Report, Int'l Application No. PCT/EP2014/073596, Feb. 2, 2015, European Patent Office, Rijswijk, NL, 12 pgs.

*Primary Examiner* — Xuong Chung Trans
(74) *Attorney, Agent, or Firm* — Holland & Hart LLP

(57) ABSTRACT

An electrical connector for electrically contacting an electrical conductor includes a sheath clamp configured for insertion of the electrical conductor, a plug contact pin for fitting onto a socket, and a contact bridge on which the sheath clamp and the plug contact pin are secured. A connection device includes an electrical connector and a contact support. The electrical connector includes a sheath clamp and a plug contact pin. The contact support is configured to receive the electrical connector and includes a sheath clamp aperture and a plug aperture.

18 Claims, 19 Drawing Sheets

(58) Field of Classification Search
USPC ..... 439/792
See application file for complete search history.

(56) References Cited

U.S. PATENT DOCUMENTS

| | | | | |
|---|---|---|---|---|
| 6,379,197 | B2 * | 4/2002 | Matsuda | H01R 4/301 439/801 |
| 7,559,810 | B1 | 7/2009 | Wu | |
| 7,566,250 | B1 * | 7/2009 | Good | H01R 4/32 174/78 |
| 8,105,118 | B2 * | 1/2012 | Claprood, Jr. | H01R 4/304 439/709 |
| 8,608,518 | B2 * | 12/2013 | Wu | H01R 4/302 439/812 |
| 2010/0203748 | A1 | 8/2010 | Wason et al. | |

FOREIGN PATENT DOCUMENTS

| | | | |
|---|---|---|---|
| DE | W839 | M | 1/1950 |
| DE | 872 595 | B | 4/1953 |
| DE | 18 01 263 | U | 9/1959 |
| DE | 1 199 353 | B | 4/1966 |
| DE | 19 33 645 | A | 1/1970 |
| DE | 29817007 | U1 | 12/1998 |
| DE | 299 16 602 | U1 | 2/2000 |
| DE | 100 53 302 | A1 | 10/2001 |
| DE | 103 39 670 | B4 | 2/2006 |
| DE | 202011103484 | U1 | 10/2012 |
| EP | 2 139 072 | A2 | 12/2009 |
| FR | 2 215 713 | A1 | 1/1973 |
| FR | 2 330 293 | A7 | 12/1973 |
| WO | WO 98/53531 | A1 | 11/1998 |
| WO | WO-2013/019540 | A1 | 2/2013 |

* cited by examiner

ELECTRICAL CONNECTOR WITH A SHEATH CLAMP

CROSS-REFERENCE TO RELATED APPLICATION

The present application is a 373 national phase filing of International Application No. PCT/EP2014/073596, entitled "Electrical Connector with a Sheath Clamp", filed Nov. 3, 2014, which claims priority to German Patent Application No. 10 2013 112 083.0, entitled "Elektrischer Verbinder mit einer Mantelklemme", filed Nov. 4, 2013, and to German Patent Application No. 10 2013 112 084.9, entitled "Anschlussvorrichtung mit einem elektrischen Verbinder", filed Nov. 4, 2013.

BACKGROUND

Some sheath clamps have a sheath formed as a cap nut. A pressure piece, which is rotatably connected to the sheath, is locked relative to a base by means of screw locking means. The sheath clamp allows two stripped wire ends to be fixed in an antiparallel alignment. However, this form of conductor feed does not permit connection of another conductor in the perpendicular direction with a small installation space requirement.

SUMMARY

The present disclosure relates to an electrical connector for electrically contacting an electrical conductor having a sheath clamp for inserting the electrical conductor. The objective of the present disclosure is therefore to provide an electrical connector for electrically contacting electrical conductors which has minimal installation space requirements and which permits additional connections.

This objective is achieved by means of the subject matter and the features in accordance with the independent claims. Advantageous embodiments are the subject matter of the dependent claims, the description and the drawings.

According to a first example, the objective is achieved by means of an electrical connector for electrically contacting an electrical conductor having a sheath clamp for inserting the electrical conductor, a plug contact pin for fitting onto a socket and a contact bridge, on which the sheath clamp and the plug contact pin are secured. By means of the combination of a sheath clamp with a pin-socket contact and a busbar as the contact bridge, the technical advantage is achieved, for example, that the connection and distribution functions of the sheath clamp for the parallel introduced/fed through flexible conductors and the plugging functions of the pin-socket contact are offset and are situated in different planes, without interfering with one another during assembly.

The electrical connector can be used, for example, in a functional automation technology component, for example in a component construction system, in particular in a fieldbus system.

In an advantageous embodiment of the electrical connector, the sheath clamp is electrically connected to the contact bridge, in particular screwed on, riveted, pressed on or spot welded. This results in the technical advantage, for example, that a rigid connection can be established in a simple technological manner between the sheath clamp and the contact bridge.

In another advantageous embodiment of the electrical connector, the contact bridge comprises a sheath clamp aperture for the electrical connection with the sheath clamp. This results in the technical advantage, for example, that the sheath clamp can be inserted into the contact bridge.

In another advantageous embodiment of the electrical connector, the sheath clamp comprises a setscrew for attaching the sheath clamp to the contact bridge by means of a nut. Alternatively, attachment can be realized by means of a rivet, a pressing operation or spot welding. This results in the technical advantage, for example, that the inserted sheath clamp can be attached in a simple manner.

In another advantageous embodiment of the electrical connector, a disk spring is disposed between the nut and the contact bridge. This results in the technical advantage, for example, that an unintentional release of the sheath clamp is prevented.

In another advantageous embodiment of the electrical connector, the contact bridge comprises a pin aperture for inserting the plug contact pin. This results in the technical advantage, for example, that the plug contact pin can be attached in a simple manner.

In another advantageous embodiment of the electrical connector, the pin aperture comprises radial cavities. This results in the technical advantage, for example, that yielding sections are created around the pin aperture, which facilitate insertion of the plug contact pin.

In another advantageous embodiment of the electrical connector, the sheath clamp comprises a sheath clamp bottom part and a screw-on sheath clamp top part. This results in the technical advantage, for example, that the electrical conductor can be attached in a simple manner.

In another advantageous embodiment of the electrical connector, the sheath clamp bottom part comprises a U-shaped cavity for inserting the electrical conductor. This results in the technical advantage, for example, that the conductor is surrounded by the sheath clamp bottom part and can be reliably clamped.

In another advantageous embodiment of the electrical connector, the U-shaped cavity is slanted at the top in order to allow simple insertion of the pressure piece.

In another advantageous embodiment of the electrical connector, the sheath clamp top part comprises a receiver for a turning tool, in particular a slot, a groove, a hexagonal head or a hexagonal hole for the insertion of a turning tool. This results in the technical advantage, for example, that a high contact pressure can be generated on the electrical conductor.

In another advantageous embodiment of the electrical connector, the sheath clamp top part is formed with a sleeve-like shape for receiving the sheath clamp bottom part. This results in the technical advantage, for example, that a reliable electrical connection between the conductors can be established.

In another advantageous embodiment of the electrical connector, the sheath clamp top part comprises a pressure piece rotatably mounted on the inside. This results in the technical advantage, for example, that the pressure piece can be pressed onto the electrical conductors in the U-shaped cavity.

In another advantageous embodiment of the electrical connector, the sheath clamp top part comprises a rigid pressure pin on the inside. This results in the technical advantage, for example, that the pressure pin can be pressed onto the electrical conductors.

In another advantageous embodiment of the electrical connector, the plug contact pin comprises a tapered section for insertion into the pin aperture. This results in the technical advantage, for example, that jamming during mounting of the plug contact pin is prevented.

In another advantageous embodiment of the electrical connector, the plug contact pin comprises a stop section so as to form a stop when the plug contact pin is inserted into the pin aperture. This results in the technical advantage, for example, that the plug contact pin can be inserted precisely into the intended position.

In another advantageous embodiment of the electrical connector, the plug contact pin extends parallel to the sheath clamp. This results in the technical advantage, for example, that electrical conductors can be fed into the sheath clamp from the sides, and a socket for establishing another electrical contact can be fitted onto the plug contact pin from above.

According to a second example, the objective is achieved by means of a connection device having an electrical connector for connecting electrical conductors, which comprises a sheath clamp and a plug contact pin, and a contact support for receiving the electrical connector, which comprises a sheath clamp aperture for the insertion of the electrical conductor into the sheath clamp and a plug aperture for fitting a socket onto the plug contact pin. The connection device comprises a feed channel between the sheath clamp aperture and the sheath clamp. This results in the technical advantage, for example, that the connection and distribution functions of the sheath clamp for the introduced/fed through flexible conductors are arranged in a compact manner and greater compression of the wiring space is obtained compared with the use of installation boxes with multipolar standard clamps and bridges.

The connection device can, for example, be used in a functional automation technology component, for example in a component construction system, in particular in a fieldbus system.

In an advantageous embodiment of the connection device, the sheath clamp aperture is disposed on a side wall of the contact support. This results in the technical advantage, for example, that the electrical wire can be fed in a simple manner when the connection device is mounted on a wall.

In another advantageous embodiment of the connection device, the contact support comprises a first sheath clamp aperture on a side wall and a second sheath clamp aperture on an opposite side wall. This results in the technical advantage, for example, that a continuous feed channel for connecting electrical conductors is created.

In another advantageous embodiment of the connection device, the plug aperture is disposed on a top side of the contact support. This results in the technical advantage, for example, that a plugging technology branch is enabled perpendicular to the wiring plane.

In another advantageous embodiment of the connection device, the contact support comprises an insulating marking cap for fitting onto a sheath clamp top part of the sheath clamp. This results in the technical advantage, for example, that different colored marking caps can be used to identify individual connections and touch protection is improved.

In another advantageous embodiment of the connection device, the insulating marking cap comprises a thumb wheel profile. This results in the technical advantage, for example, that the sheath clamp top part can be manually actuated.

In another advantageous embodiment of the connection device, the insulating marking cap comprises a cavity for accessing a groove of the sheath clamp top part of the sheath clamp. This results in the technical advantage, for example, that both a turning tool and a measuring tip for tapping a voltage can be inserted into the sheath clamp top part.

In another advantageous embodiment of the connection device, the contact support comprises a screw channel for the insertion of the rotatable sheath clamp top part of the sheath clamp. This results in the technical advantage, for example, that the sheath clamp top part is fed in a touch-safe manner in the connection device.

In another advantageous embodiment of the connection device, the contact support comprises a color marking cartridge for insertion into the screw channel. This results in the technical advantage, for example, that a user-specific color identification and labeling of the connection areas is obtained.

In another advantageous embodiment of the connection device, the contact support comprises a housing top part and a housing bottom part. This results in the technical advantage, for example, that a modular construction of the connection device is obtained and the housing top part and the housing bottom part can be injection molded parts.

In another advantageous embodiment of the connection device, the electrical connector is inserted with the plug contact pin into a cavity in the housing bottom part. This results in the technical advantage, for example, that the electrical connector can be supported at a primary point when the connection device is assembled.

In another advantageous embodiment of the connection device, the housing top part and the housing bottom part are engaged with one another. This results in the technical advantage, for example, that the connection device can be produced in a simple manner.

In another advantageous embodiment of the connection device, the electrical connector is fixed between the housing top part and the housing bottom part. This likewise results in the technical advantage, for example, that the connection device can be produced in a simple manner.

In another advantageous embodiment of the connection device, the contact support comprises an elastomer element for fixing the electrical conductor in the sheath clamp aperture. This results in the technical advantage, for example, that the electrical conductor can be clamped in a feed channel.

In another advantageous embodiment of the connection device, the contact support has a plurality of receivers for each electrical connector. This results in the technical advantage, for example, that a plurality of electrical wires can be connected with a single connection device.

BRIEF DESCRIPTION OF TIM DRAWINGS

Additional examples are explained with reference to the accompanying drawings, in which.

DETAILED DESCRIPTION

Figure 1:
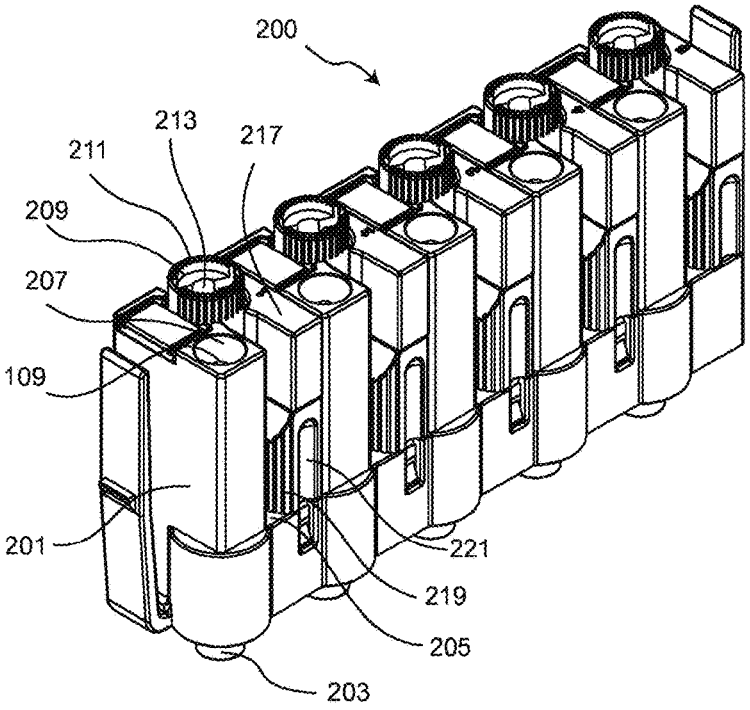
FIG. 1 shows a view of a connection device.

FIG. 1 shows a view of a connection device 200. The connection device 200 is used for the electrical connection of electrical conductors. For this purpose, the connection device 200 comprises several electrical connectors, which are disposed on the inside of the connection device 200 in a specially designed contact support 201 and 203.

The contact support 201 comprises a housing top part 201 and a housing bottom part 203. The electrical connectors are inserted and fixed between the housing top part 201 and the housing bottom part 203. Engagement means are disposed in the housing top part 201 and the housing bottom part 203 for engaging the housing top part 201 with the housing bottom part 203.

The electrical connectors each comprise a sheath clamp and a plug contact pin 109. The sheath clamp enables the connection of several non-terminated fine-wire conductors having different cross sections without impairment of visual clarity in a mounting area.

The housing top part 201 comprises several sheath clamp apertures 205, by means of which the electrical conductors can be introduced laterally into the sheath clamps of the electrical connectors. The sheath clamp apertures 205 are disposed on the side wall of the contact support. The connection device 200 comprises a feed channel between the sheath clamp aperture 205 and the sheath clamp. On the top side of the housing top part 201 there are several plug apertures 207, which are used for establishing an electrical connection by means of the plug contact pin 109.

In order to open and close the sheath clamp mounted on the inside of the contact support 201 and 203, a rotatable marking cap 209 is provided, which is placed on a sheath clamp top part. The marking cap 209 can be replaced by a user so that, depending on a used color of the marking cap 209, a conductor type can be identified. The marking cap 209 is formed from an electrically insulating material and is used for fitting onto the sheath clamp top part 105 of the sheath clamp 103, 105.

The marking cap 209 comprises an edge with a thumb wheel profile 211, allowing the marking cap to be manually turned with maximum grip by a user. Adjacent thereto, the marking cap 209 comprises a cavity 213 for accessing a groove of the sheath clamp top part of the sheath clamp.

A color marking cartridge 217 is inserted into a screw channel for the sheath clamp, which cartridge can be replaced by a user according to the desired color. The color marking cartridges 217 permit a color identification and labeling of the connection areas.

Cylinder-shaped elastomer elements 219, which hold the electrical conductors in position, are disposed at the point of entry of the conductors into the contact support 201. The elastomer elements 219 are fitted to the different conductor diameters through their particular shape and their internal construction. A counterforce is generated by means of the wall of the upwards outgoing pin contact of the double plug outlet.

The color marking cartridge 217 is displaceably disposed in the screw channel on that, when the marking cap 209 is closed, the color marking cartridge 217 is simultaneously moved towards an elastomer element 219. The color marking cartridge 217 thus additionally serves as a compression device for the elastomer element 219.

The elastomer element 219 is disposed laterally in the sheath clamp aperture 205, so that an inserted conductor is situated between an internal wall of the sheath clamp aperture 205 and the elastomer element 219. If the elastomer element 219 is compressed from above by the color marking cartridge 217, the elastomer element expands laterally and thus fixes the inserted electrical conductor in place. A central cavity 221 on the inside of the elastomer element 219 facilitates the lateral expansion of the elastomer element 219.

The term "elastomers" is understood to mean dimensionally stable, but elastically deformable plastics, the glass transition temperature of which is below the operation temperature. The elastomers can elastically deform with tension and compression, but subsequently return to their original undeformed shape. The elastomer can be produced from a material that contains natural rubber and/or silicone rubber.

The connection device 200 enables a connection and a reconnection of two or more cut, fine-wire electrical conductors of a main circuit without appreciable transition resistance and with low thermal losses. In addition, the plug contact pin 109 creates an open clamping area, in which the conductor feeding direction runs perpendicular to the conductor instead of in the conductor direction. The arrangement of the plug contact pin 109 enables contacting at additional assembly and installation planes. The connection device 200 comprises five electrical connections with the respective connectivity options. The connection device 200 permits a compression of the wiring space compared with the use of installation boxes with multipolar standard clamps and bridges and enables a plugging technology branch from the multipolar conductor clamping area perpendicular to the wiring plane.

Figure 2:
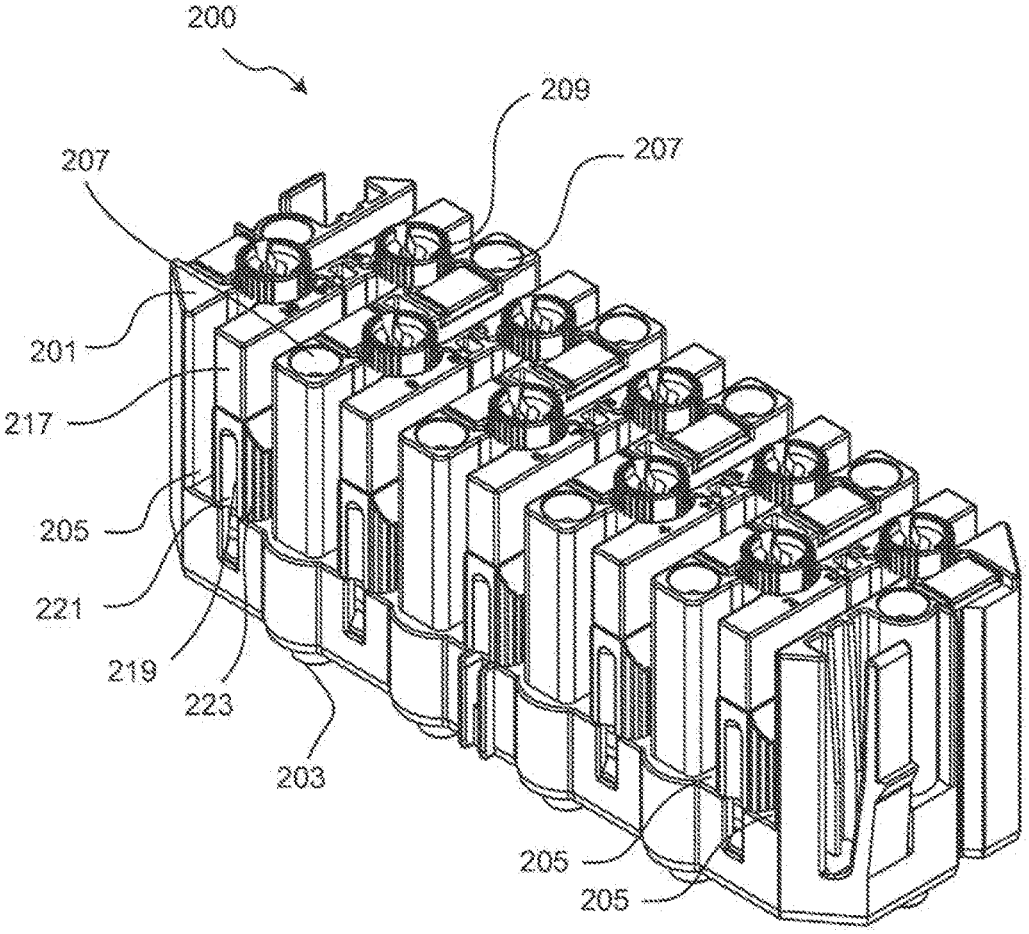
FIG. 2 shows a view of another connection device.

FIG. 2 shows a view of another connection device 200. The connection device 200 comprises ten electrical connectors with the respective connectivity options. The electrical connectors are oriented alternately opposite one another on the inside of the contact support 201 and 203. The elastomer element 219 is disposed between two sheath clamp apertures 205 so that, when the elastomer element 219 is compressed, one or two left and right electrical conductors can be simultaneously fixed in place. In addition, the elastomer element 219 comprises a lateral retaining profile 223, which improves the adhesion to the inserted electrical conductor. The elastomer element 219 is disposed between the color marking cartridge 217 and the contact support 201,203.

A first sheath clamp aperture 205 is disposed on a side wall and a second sheath clamp aperture 205 is disposed on an opposite side wall, so that these form a continuous feed channel for the insertion of an electrical conductor into the contact support 201. The contact support 201 comprises a sheath clamp aperture 205 having a first elastomer element 219 on its side wall and a second sheath clamp aperture 205 having a second elastomer element 219 on the opposite side wall.

Feed channels for the insulated conductors thus extend on both sides up to the clamping point embedded in the contact support 201. Fine-strand and non-terminated wires of different cross sections can be inserted into the feed channels. A stripped conductor inserted into the open clamping point is held in position in the feed channel, while additional conductors can be inserted into the clamping point. The conductors can be inserted and held from both sides.

Figure 3:
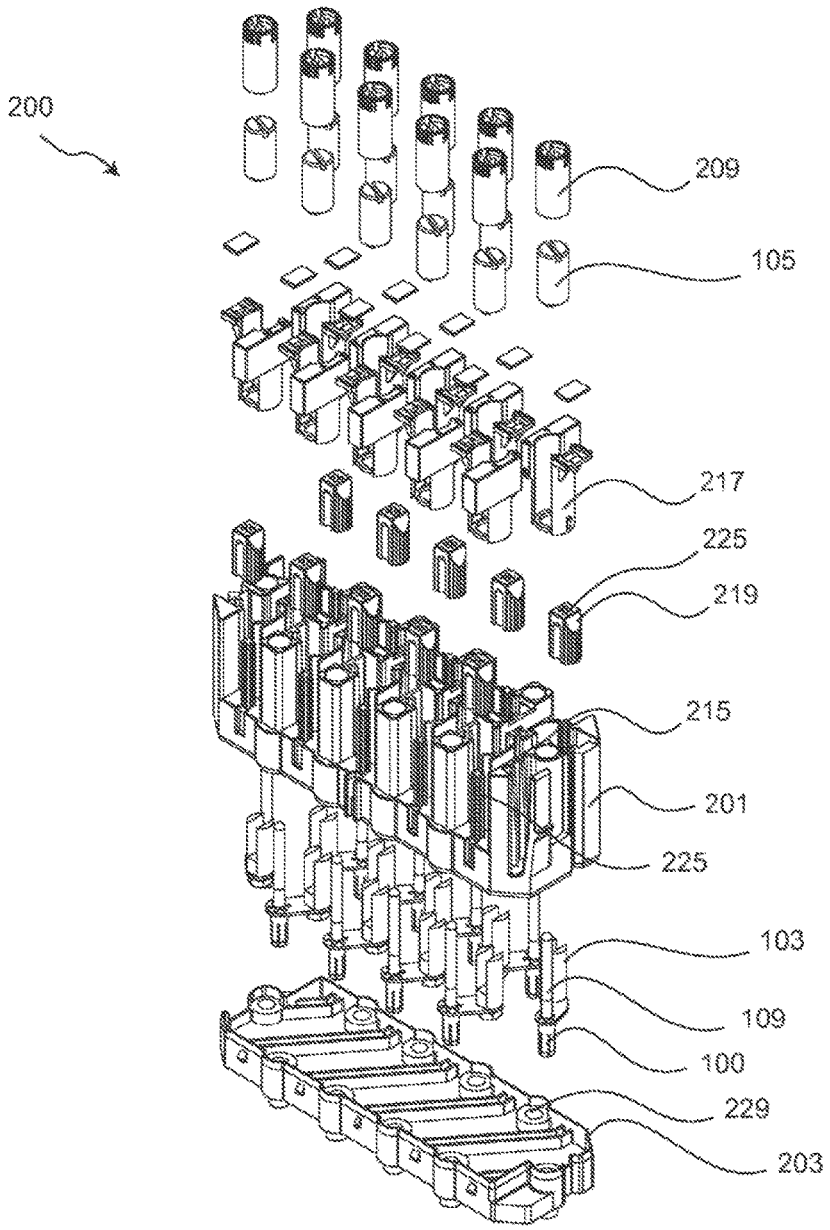
FIG. 3 shows an exploded view of the connection device.

FIG. 3 shows an exploded view of the connection device 200. The connection device 200 is made up of the housing bottom part 203, the inserted electrical connectors 100 with a sheath clamp bottom part 103 and the plug contact pin 109, the housing top part 201, the elastomer elements 219, the color marking cartridges 217, the sheath clamp top parts 105 and the marking caps 209. The sheath clamp top part 105 is used for the sleeve-like reception of the sheath clamp bottom part 103.

The housing top part 201 comprises the screw channels 15, into which the color marking cartridges 217 are inserted together with the sheath clamp top parts 105 and the color marking cartridges 217. The contact support 201,203 thus comprises the screw channel 215 for the insertion of the rotatable sheath clamp top part 105 of the sheath clamp 103, 105.

In addition, the housing top part 201 comprises spikes 225 for fitting the elastomer elements 219 onto it. For this purpose, the elastomer elements 219 also have a continuous cavity 227, into which the spikes 225 are inserted. The spikes 225 and the cavities 227 have a cruciform cross section, so that twisting of the elastomer elements 219 is prevented. The elastomer elements 219 have a cylindrical basic shape. When the connection device has been assembled, the spikes 225 extend into the color marking cartridges 217. For this purpose, the color marking cartridges 217 have a corresponding cavity. It is thus possible to prevent any bending of the spikes 225.

For each electrical connector 100, the housing bottom part 203 comprises a cavity 229, into which a lower section of the plug contact pin 109 is inserted. The electrical connector 100 is inserted with the plug contact pin 109 into the housing bottom part. This allows the electrical connectors 100 to be supported at a primary point in the housing bottom part 203 and the assembly of the connection device 200 is simplified with respect to putting together the individual components.

Figure 4:
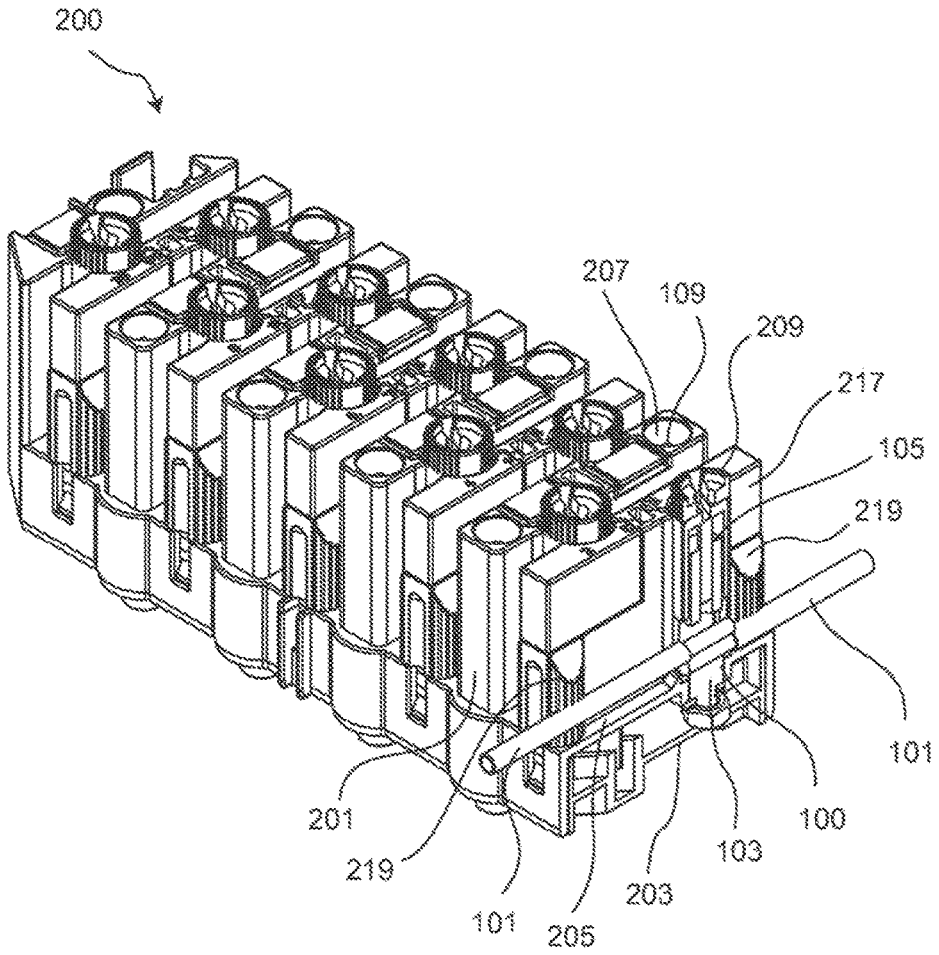
FIG. 4 shows another view of the connection device with inserted electrical conductors.

FIG. 4 shows another view of the connection device 200 with the inserted electrical conductors 101. The electrical conductors 101 are inserted from both sides into the respective sheath clamp aperture 205 and extend up to the sheath clamp 103 and 105. In the sheath clamp apertures 205, the electrical conductors 101 extend laterally beyond the elastomer elements 219. When the elastomer elements 219 are pressed together, the electrical conductors 101 are clamped between the elastomer elements 219 and a side wall, which is not depicted.

Figure 5:
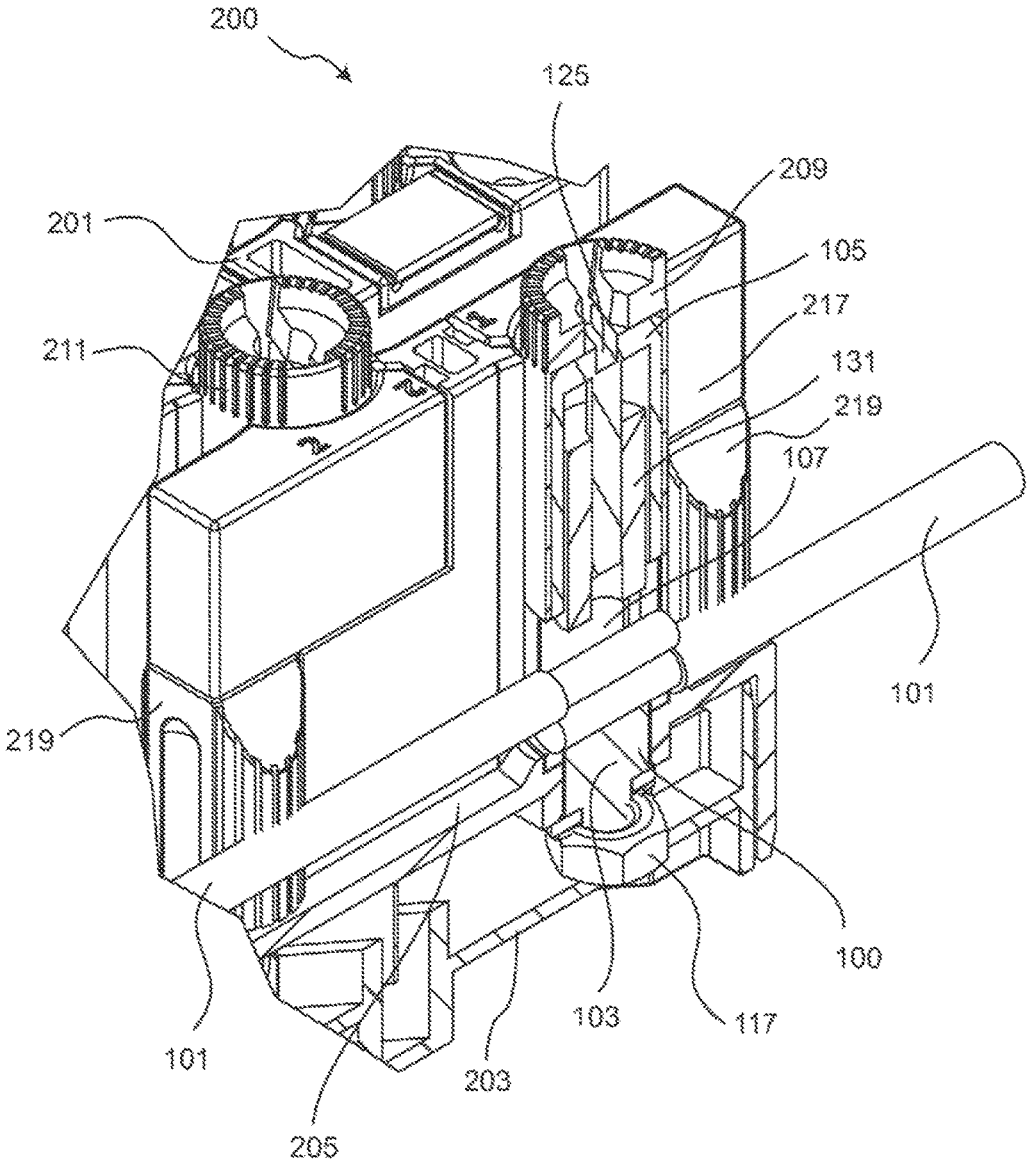
FIG. 5 shows an enlarged view through the connection device.

FIG. 5 shows an enlarged view through the connection device 200 with inserted electrical conductors 101. The stripped ends of the electrical conductors 101 lie in a U-shaped receiver 107 of the sheath clamp bottom part 103 and are pressed by means of a pressure piece 131 in the sheath clamp top part 105 onto the sheath clamp bottom part 103, so that an electrical contact is established. For this purpose, the sheath clamp top part 105 is rotated, so that it moves downwards. The sheath clamp 103 and 105 is attached by means of a nut 117.

On the top side of the sheath clamp aperture 205 there is a groove 128 or similar means for the insertion of a turning tool, such as a screwdriver, for example.

Figure 6:
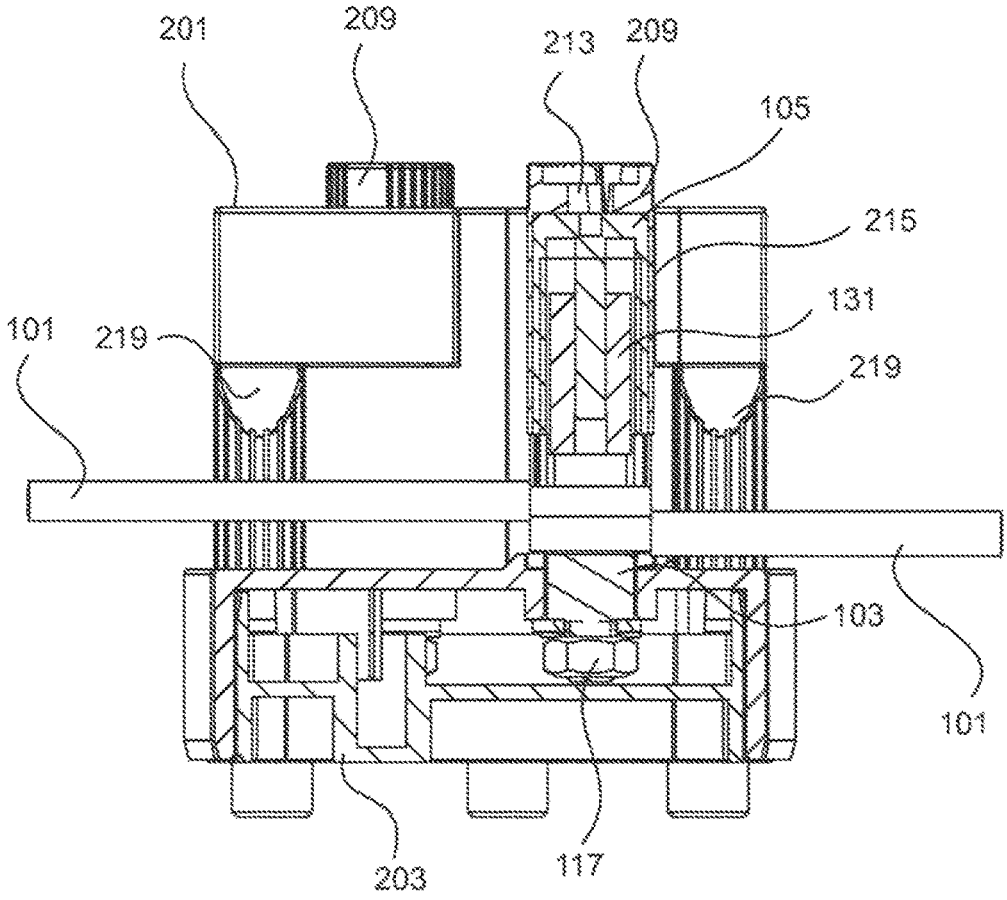
FIG. 6 shows an enlarged cross-sectional view through the connection device.

FIG. 6 shows an enlarged cross-sectional view through the connection device 200. The sheath clamp 103 and 105 is in the opened position. The electrical conductors 101 are situated in front of the respective elastomer elements 219. The cavity 213 for accessing the groove of the sheath clamp top part 105 which lies beneath it is provided in the marking cap 209.

Figure 7:
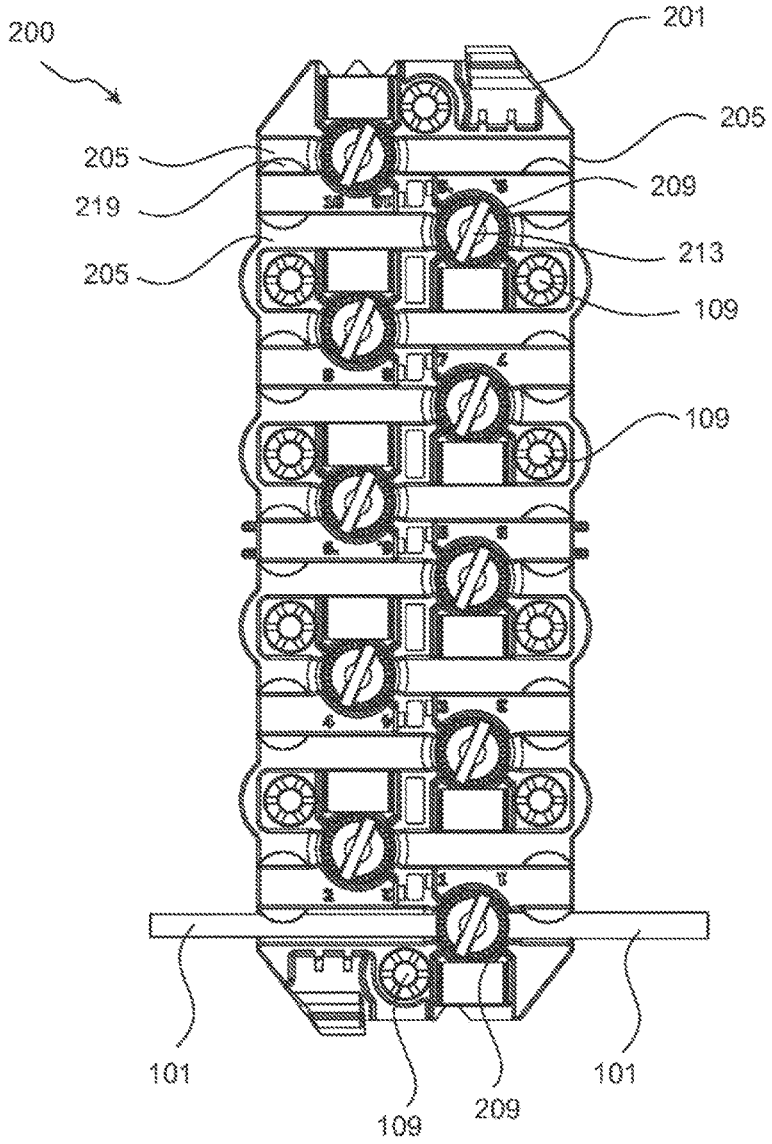
FIG. 7 shows a top view of the connection device.

FIG. 7 shows a top view of the connection device 200. The marking caps 209 with the sheath clamps 103 and 105 lying beneath it are disposed alternately on the left and the right on the top side of the housing top part 203. The plug contact pins 109 are each situated next to the associated marking caps 209. The electrical conductors 101 are inserted from the left and the right of the connection device 200 into the sheath clamp aperture 205.

Figure 8:
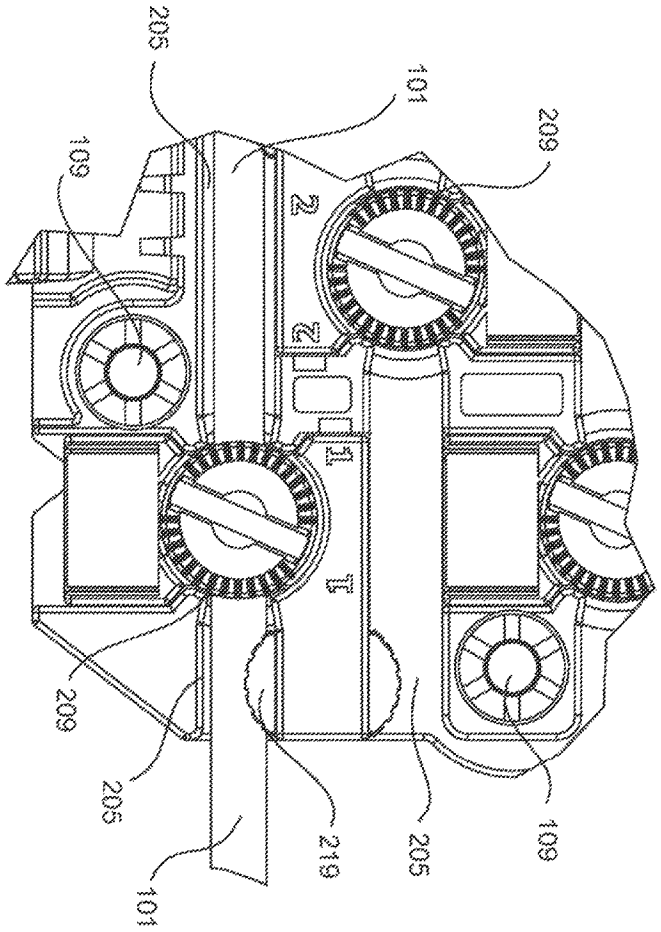
FIG. 8 shows an enlarged top view of the connection device.

FIG. 8 shows an enlarged top view of the connection device 200. The elastomer element 219 presses laterally against the inserted electrical conductors 101 and fixes them in place through an abutment of the retaining profile 223 on the electrical conductor 101. The elastomer elements 219 thus apply a grip to the surface of the conductor insulation due to their particular surface design.

Figure 9:
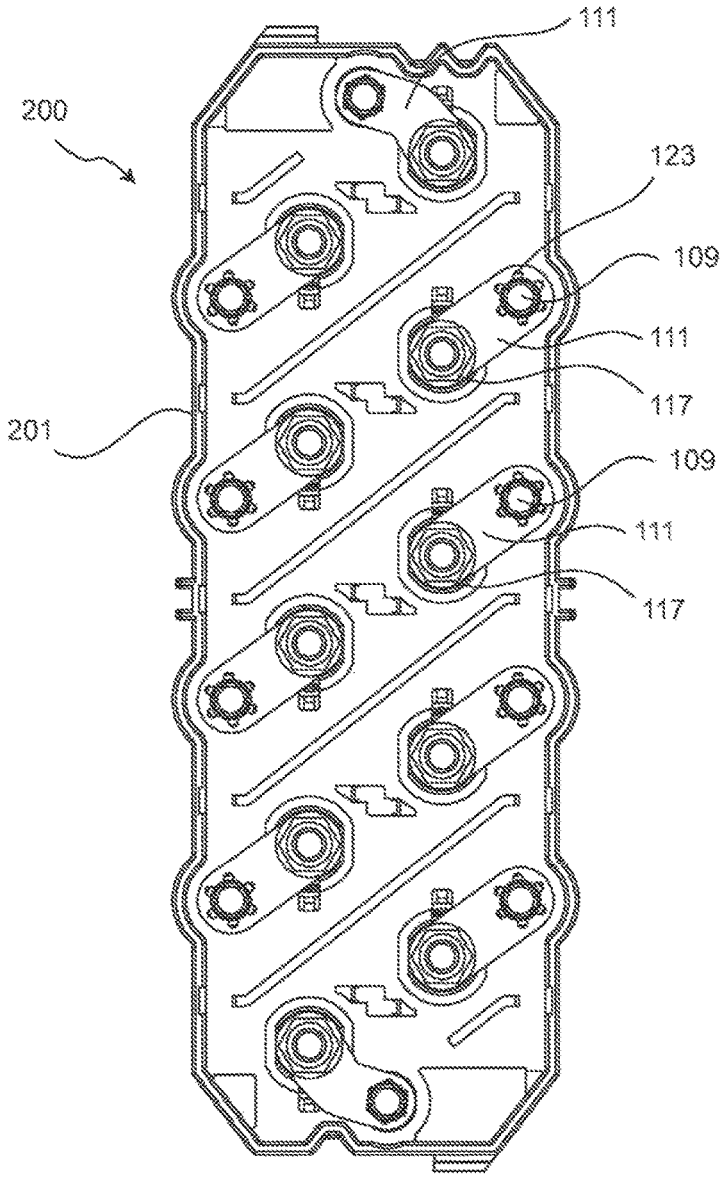
FIG. 9 shows a bottom view of the connection device.

FIG. 9 shows a bottom view of the housing top part 201 of the connection device 200. The sheath clamps and the plug contact pins 109 are electrically connected to one another via a contact bridge 111 and are attached to the contact bridge 111 at a spacing to one another. The contact bridges 111 are disposed diagonally on the inside of the contact support 201 and 203.

Figure 10:
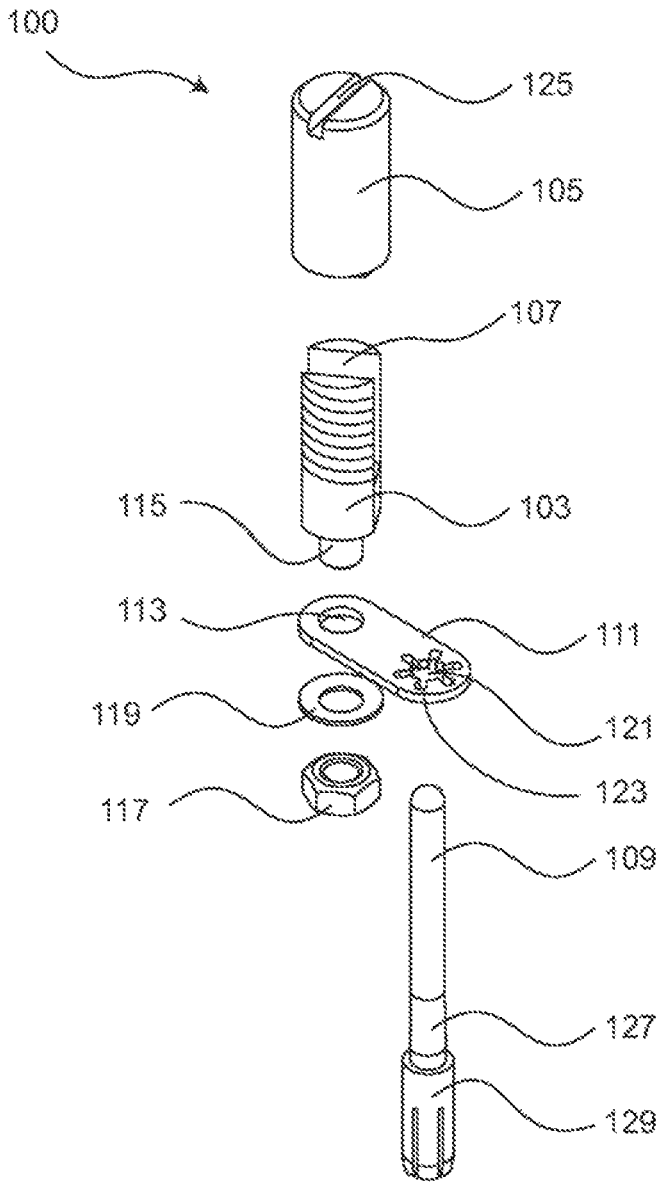
FIG. 10 shows an exploded depiction of an electrical connector.

FIG. 10 shows an exploded depiction of an electrical connector 100. The electrical connector 100 is made up of the plug contact pin 109, the plate-shaped contact bridge 111 and the sheath clamp which comprises the sheath clamp bottom part 103 and the sheath clamp top part 105. The plate-shaped contact bridge 111 is formed from a metal strip and comprises a sheath clamp aperture 113 for the insertion of the sheath clamp 103, 105 and a pin aperture 121 for the insertion of the plug contact pin 109. The contact bridge 111 has a rectangular basic shape, the sides of which are semi-circular.

The plug contact pin 109 comprises a tapered section 127 and a stop section 129. The tapered section 127 becomes broader in the direction of the stop section 129, so that this has increasing purchase when inserted into the pin aperture 121. The stop section 129 forms a stop when the plug contact pin 109 is inserted, so that the plug contact pin 109 can be secured in the envisaged position.

Cavities 123 are disposed radially around the pin aperture 121 and, by means of these cavities, elastic sections are created around the pin aperture 121 in the contact bridge 111, which yield slightly when the tapered section 127 is inserted and fix the plug contact pin 109 to the contact bridge 111.

The sheath clamp bottom part 103 comprises a U-shaped receiver 107 for the insertion of the electrical conductors. In addition, the sheath clamp bottom part 103 comprises a setscrew 115 with an external thread section, which is inserted into the sheath clamp aperture 113 of the contact bridge 111. The sheath clamp bottom part 103 is then secured to the contact bridge 111 by means of a nut 117 and a disk spring 119.

The sheath clamp top part 105 is screwed onto the sheath clamp bottom part 103, so that the inserted electrical conductors are clamped between both parts. In order to screw the sheath clamp top part 105 to the sheath clamp bottom part 103, the groove 125 is provided on the top side, into which groove a screwdriver can be inserted.

Figure 11:
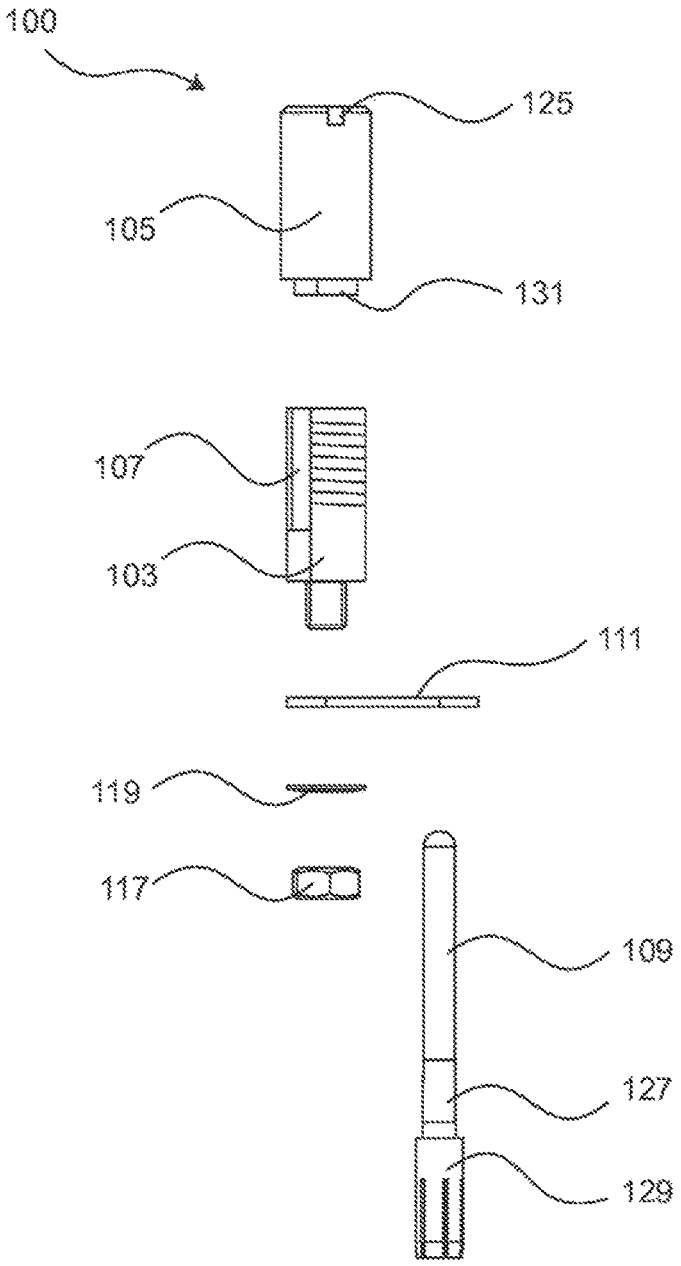
FIG. 11 shows a lateral exploded depiction of the electrical connector.

FIG. 11 shows a lateral exploded depiction of the electrical connection 100. The pressure piece 131 protrudes from the bottom side of the sheath clamp top part 105. The pressure piece 131 is rotatably mounted on the inside of the sleeve-like sheath clamp top part 105 and is inserted into the U-shaped receiver when the sheath clamp top part 105 is fitted onto the sheath clamp bottom part 103. When the sheath clamp top part 105 and the sheath clamp bottom part 103 are screwed together, the pressure piece 131 is pressed onto the electrical conductors lying in the receiver 107, so that an electrical contact can be established between these.

Figure 12:
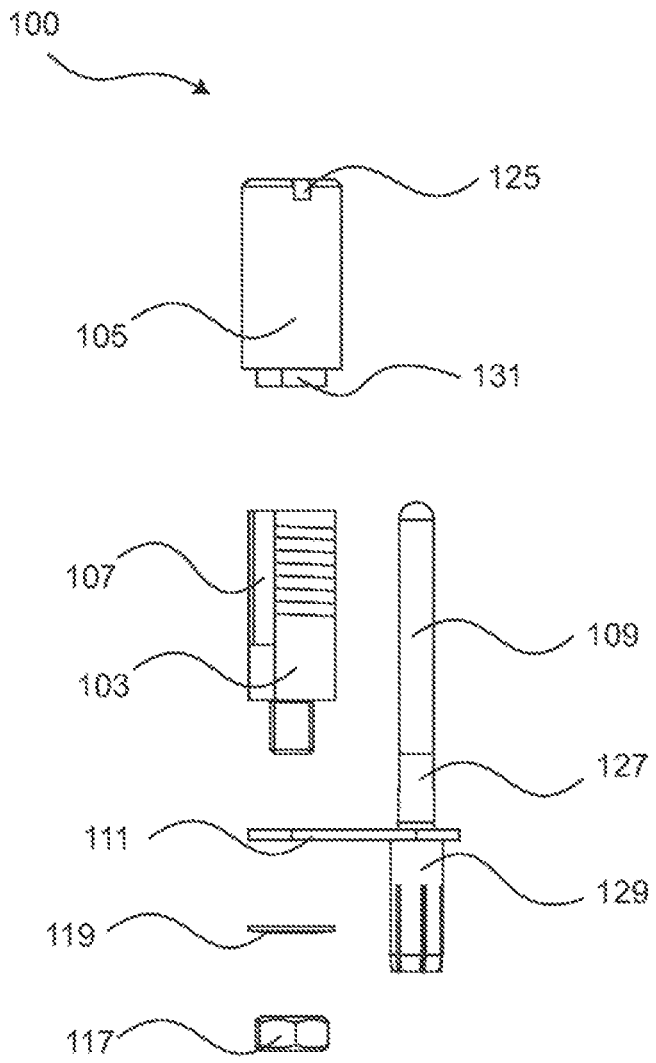
FIG. 12 shows another lateral exploded depiction of the electrical connector.

FIG. 12 shows another lateral exploded depiction of the electrical connector 100. In this view, the plug contact pin 109 is inserted into the plug aperture 121 in the contact bridge 111. A conductive connection is established between the plug contact pin 109 and the contact bridge 111. The plug contact pin 109 protrudes vertically from the contract bridge 111.

Figure 13:
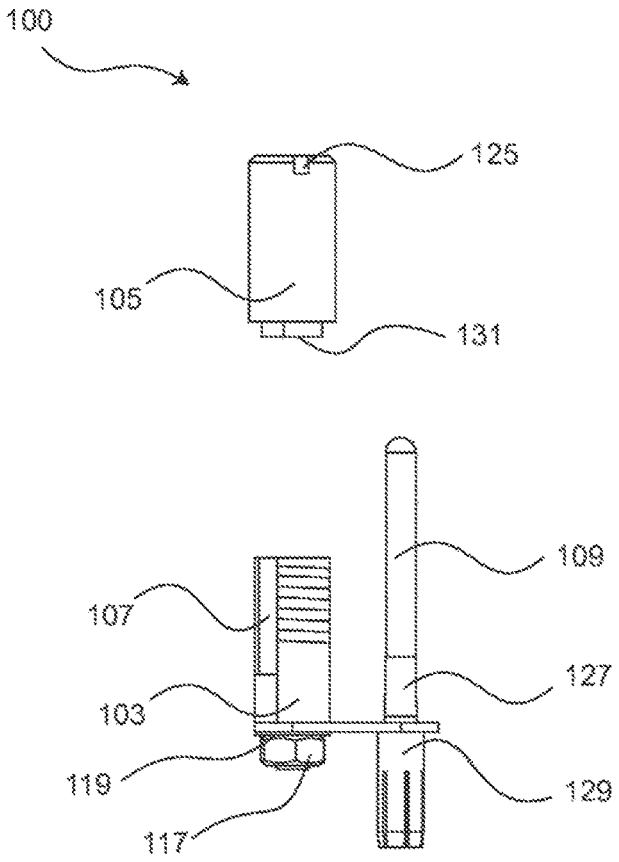
FIG. 13 shows a side view of the electrical connector.

FIG. 13 shows a side view of the electrical connector 100. In this view, the sheath clamp bottom part 103 is screwed onto the contact bridge 111 by means of the nut 117. This establishes a conductive connection between the contact bridge 111 and the sheath clamp bottom part 103. The disk spring 119 is inserted between the contact bridge 111 and the nut 117. The disk spring 119 maintains tension on the screw connection and prevents release of the nut 117. The plug contact pin 109 extends parallel to the sheath clamp 103, 105.

Figure 14:
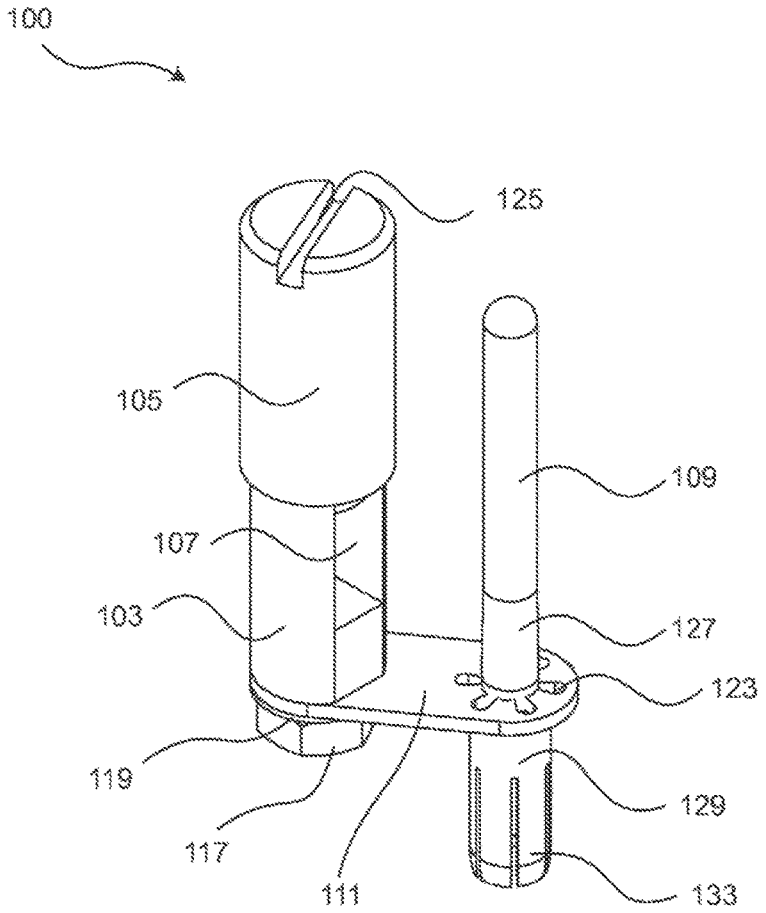
FIG. 14 shows a view of the assembled electrical connector.

FIG. 14 shows a view of the assembled electrical connector 100. In this view, the sheath clamp top part 105 is screwed onto the sheath clamp bottom part 103. Situated between the two parts is the receiver 107, into which electrical conductors are inserted. The sheath clamp 103 and 105 is orientated such that the direction of insertion of the conductors into the receiver 107 is not blocked or compromised by the plug contact pin 109.

When the electrical connector 100 is mounted in the contact support 203, the stop section 129 is inserted into the cavity 229 in the housing bottom part 203 in a form-fitting manner. For this purpose, the stop section 129 has spring segments 133 on the bottom side, which are pressed together on insertion and hold the plug contact pin 109 in the cavity 229.

Figure 15:
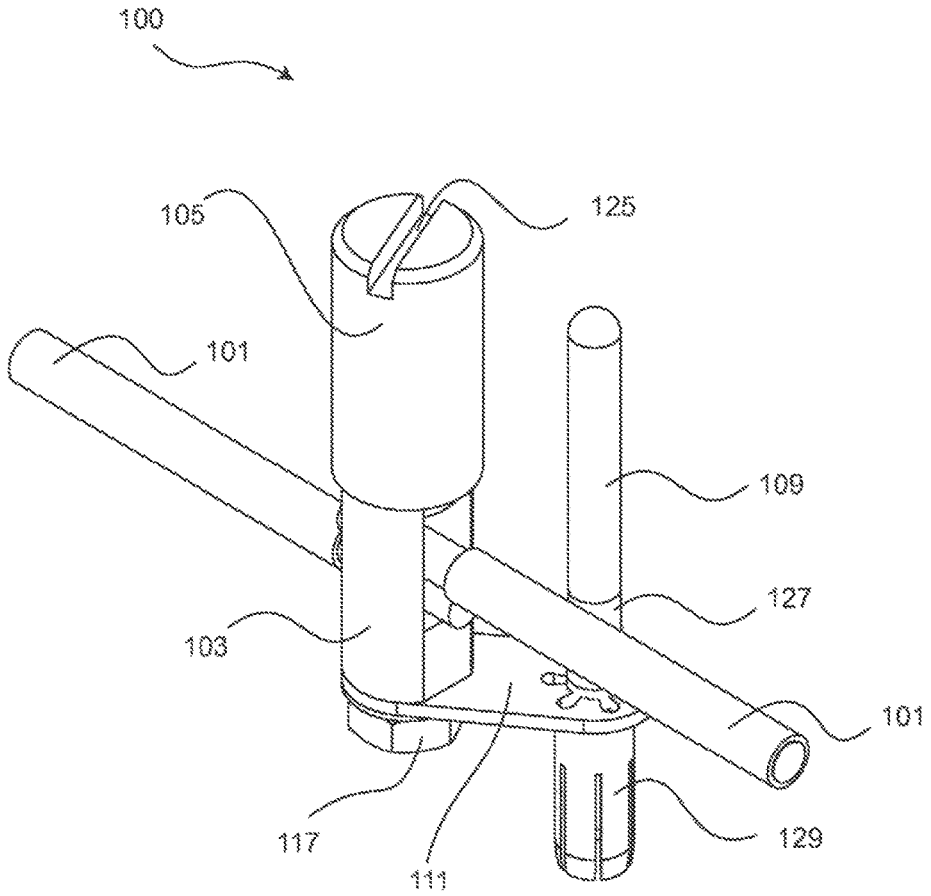
FIG. 15 shows a view of the assembled electrical connector with inserted conductors.

FIG. 15 shows a view of the assembled electrical connector 100 with inserted conductors 101. The electrical conductor 101 extends laterally beyond the contact pin 109. The electrical conductor 101 is, for example, a cable, the stripped ends of which are inserted in the receiver 107. Once the sheath clamp top part 105 has been screwed down, an electrical contact is established between the electrical conductors.

Figure 16:
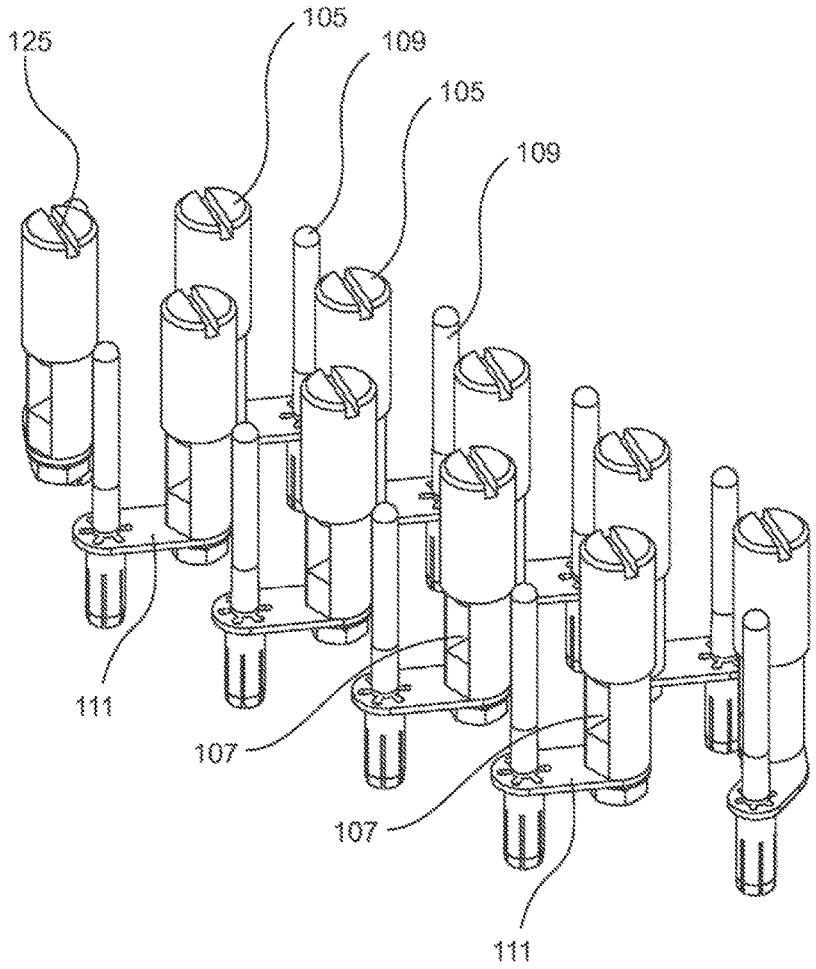
FIG. 16 shows a view of an arrangement of several electrical connectors.

FIG. 16 shows a perspective view of an arrangement of several electrical connectors 100, as they are disposed in the contact support 201 and 203 of the connection device 200. The depicted arrangement allows the electrical conductors to be more densely concentrated than with a combination of clamps having a similar task.

Figure 17:
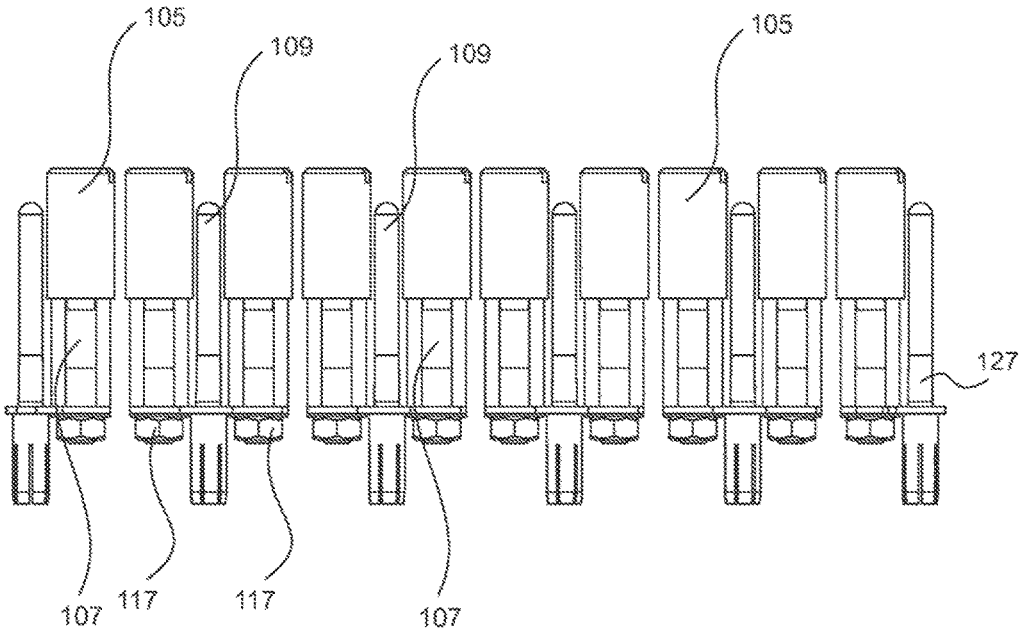
FIG. 17 shows a side view of an arrangement of several electrical connectors.

FIG. 17 shows a side view of an arrangement of several electrical connectors 100, as they are disposed in the contact support 201 and 203 of the connection device 200. The sheath clamps 105 and the plug contact pins 109 are aligned parallel to one another.

Figure 18:
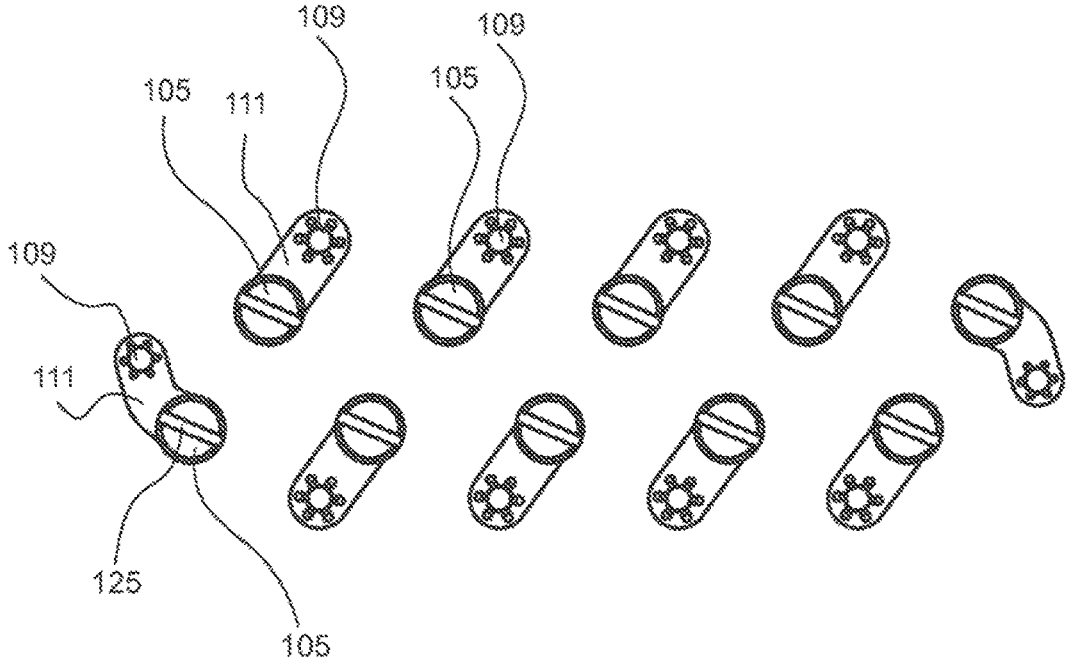
FIG. 18 shows a top view of an arrangement of several electrical connectors.

FIG. 18 shows a top view of an arrangement of several electrical connectors 100, as they are disposed in the contact support 201 and 203 of the connection device 200. The contact bridges 111 of the outer electrical connectors 100 are angled. The electrical connectors 100 are disposed diagonally.

Figure 19:
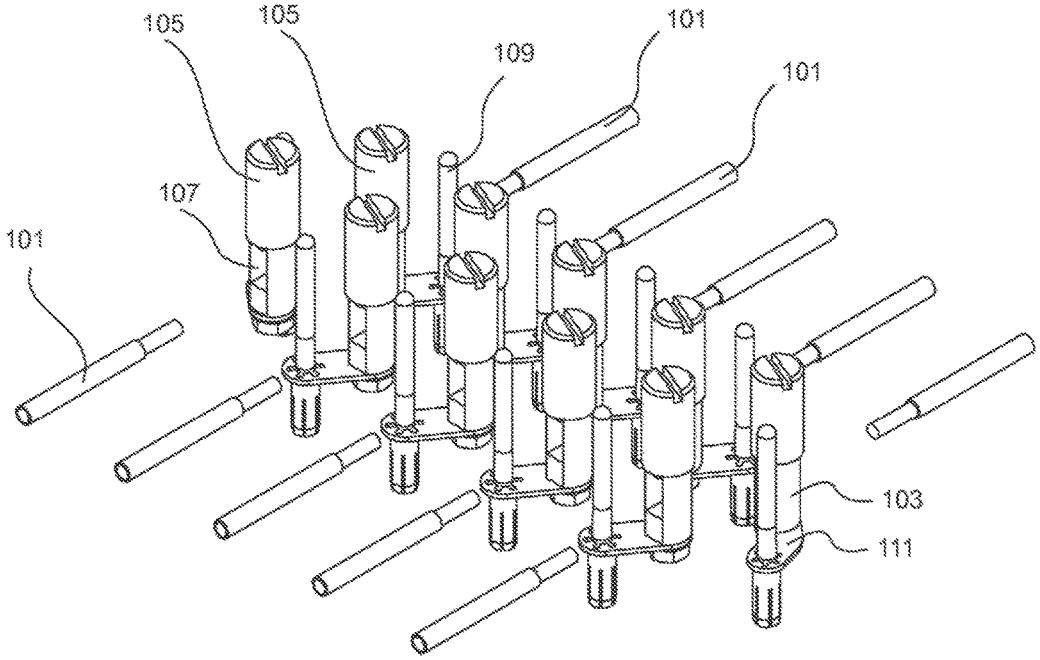
FIG. 19 shows a view of an arrangement of several electrical connectors with corresponding conductors.

FIG. 19 shows a view of an arrangement of several electrical connectors 100 with corresponding conductors 101, as they are disposed in the contact support 201 and 203 of the connection device 200.

The connection device 200 can be used in the field as space-saving cable installation technology for extra-low voltage and low voltage devices. In addition, this provides a plug connection and a potential transfer for modular and stackable housings. The connection device 200 constitutes a holistic design concept, by means of which an advantageous energy distribution is obtained in the field, i.e. outside of a control cabinet.

The connection device 200 with the contact support 201, 203 serves to guide and retain the individual conductors without impairment of visual clarity in the mounting area. In particular, a clamping space is created that is open from above and accessible from both sides. A high level of fault safety is achieved thanks to clearly organized wiring and colored identification and simple visual inspection is possible following successful installation. In addition, the individual conductors of different cross sections can be positioned, guided and retained in the contact support 201, 203.

The connection device 200 provides a high level of touch protection in the installed state with touch-safe measuring points at all potentials. A combination of a multiple clamping point for non-terminated wires with double plug technology is obtained. The contact support 201, 203 can be easily expanded with a five-pole star distributor for up to eight five-pole cables. Globally, a space-saving cable installation technology for general junction and distribution boxes is provided. In addition, assembly support is provided in junction and distribution boxes with a large number of conductors and optimized wiring.

All features explained and depicted in connection with individual examples can be envisaged in different combinations in the subject matter according to the present disclosure in order to also produce their advantageous effects.

The scope of protection of the present invention is described by the claims and is not limited by the features explained in the description or depicted in the figures.

REFERENCE NUMERAL LIST

100 Electrical connector
101 Electrical conductor
103 Sheath clamp bottom part
105 Sheath clamp top part
107 Receiver
109 Plug contact pin
111 Contact bridge
113 Sheath clamp aperture
115 Setscrew
117 Nut
119 Disk spring
121 Pin aperture
123 Cavities
125 Groove
127 Tapered section
129 Stop section
131 Pressure piece
133 Spring segments
200 Connection device
201 Contact support—housing top part

203 Contact support—housing bottom part
205 Sheath clamp aperture
207 Plug aperture
209 Marking cap
211 Thumb wheel profile
213 Cavity
215 Screw channel
217 Compression device—color marking cartridge
219 Elastomer element
221 Cavity
223 Retaining profile
225 Spike
227 Cavity
229 Cavity

The invention claimed is:

1. An electrical connector for electrically contacting an electrical conductor, the electrical connector comprising:

a sheath clamp configured for insertion of the electrical conductor;

a plug contact pin for fitting onto a socket; and a contact bridge, on which the sheath clamp and the plug contact pin are secured, wherein the contact bridge comprises a sheath clamp aperture configured for electrical connection with the sheath clamp, and a pin aperture configured for insertion of the plug contact pin; wherein the sheath clamp aperture and the pin aperture are disposed on a flat surface of the contact bridge.

2. The electrical connector according to claim 1, wherein the sheath clamp comprises a set screw configured to attach the sheath clamp to the contact bridge using a nut.

3. The electrical connector according to claim 1, wherein the sheath clamp comprises a sheath clamp bottom part and a screw-on sheath clamp top part.

4. The electrical connector according to claim 3, wherein the sheath clamp bottom part comprises a U-shaped receiver configured for insertion of the electrical conductor.

5. The electrical connector according to claim 3, wherein the sheath clamp top part comprises a least one of: a pressure piece rotatably mounted on an inside portion of the sheath clamp top part or a rigid pressure pin on the inside portion of the sheath clamp top part.

6. The electrical connector according to claim 1, wherein the plug contact pin comprises a tapered section configured for insertion into a pin aperture.

7. The electrical connector according to claim 1, wherein the plug contact pin comprises a stop section configured to form a stop when the plug contact pin is inserted into a pin aperture.

8. The electrical connector according to claim 1, wherein the plug contact pin extends parallel to the sheath clamp.

9. A connection device, comprising:

an electrical connector configured to connect electrical conductors, the electrical connector comprising: a sheath clamp and a plug contact pin; and a contact support configured to receive the electrical connector, the contact support comprising a sheath clamp aperture configured for insertion of at least one of the electrical conductors into the sheath clamp and a plug aperture for fitting a socket onto the plug contact pin of the electrical connector.

10. The connection device according to claim 9, wherein the sheath clamp aperture is disposed on a side wall of the contact support.

11. The connection device according to claim 9, wherein the sheath clamp aperture comprises one of a plurality of sheath clamp apertures of the contact support, wherein the plurality of sheath clamp apertures comprises a first sheath clamp aperture on a side wall of the contact support and a second sheath clamp aperture on an opposite side wall of the contact support.

12. The connection device according claim 9, wherein the plug aperture is disposed on a top side of the contact support.

13. The connection device according to claim 9, wherein the contact support comprises an insulating marking cap configured to fit onto a sheath clamp top part of the sheath clamp.

14. The connection device according to claim 13, wherein the insulating marking cap comprises a thumb wheel profile.

15. The connection device according to claim 13, wherein the insulating marking cap comprises a cavity providing access to a groove of the sheath clamp top part of the sheath clamp.

16. The connection device according to claim 13, wherein the contact support comprises a screw channel configured for insertion of the sheath clamp top part of the sheath clamp.

17. The connection device according to claim 9, wherein the contact support comprises a housing top part and a housing bottom part.

18. The connection device according to claim 17, wherein the electrical connector is inserted with the plug contact pin into a cavity in the housing bottom part.

* * * * *